US006810549B1

(12) United States Patent
Pi

(10) Patent No.: US 6,810,549 B1
(45) Date of Patent: Nov. 2, 2004

(54) DRAINAGE MOP

(76) Inventor: Ching-Tien Pi, 235 Chung-Ho, Box 8-24, Taipei (TW)

( * ) Notice: Subject to any disclaimer, the term of this patent is extended or adjusted under 35 U.S.C. 154(b) by 19 days.

(21) Appl. No.: 10/448,272

(22) Filed: May 30, 2003

(51) Int. Cl.[7] ..... A47L 13/144; A47L 13/14
(52) U.S. Cl. ..... 15/119.2; 15/228; 15/244.1
(58) Field of Search ..... 15/116.1, 116.2, 15/119.1, 119.2, 120.1, 120.2, 228, 244.2, 244.1

(56) References Cited

U.S. PATENT DOCUMENTS 2,761,162 A * 9/1956 Harris ..... 15/119.2
2,940,101 A * 6/1960 Arthur ..... 15/119.2
3,205,520 A * 9/1965 Trentel ..... 15/119.2
5,887,309 A * 3/1999 Lin ..... 15/119.2

* cited by examiner

*Primary Examiner*—Gary K. Graham
(74) *Attorney, Agent, or Firm*—Troxell Law Office PLLC

(57) ABSTRACT

A drainage mop has a handle unit and a drainage unit. A rotary unit is disposed between the handle unit and the drainage unit so that the handle unit can be bent with respect to the drainage unit. In bending state, the rotary unit drives a driven unit so that the water absorbing unit of the drainage unit is squeeze radially to drain water out. Thus, in draining or cleaning, the operations of the water absorbing unit can be executed easily and conveniently.

10 Claims, 9 Drawing Sheets

DRAINAGE MOP

FIELD OF THE INVENTION

The present invention relates to drainage mops, and particularly to a drainage mop, wherein a rotary unit is positioned and connected to a handle unit and a drainage unit so that when the handle unit is bent relative to the drainage unit, a rotary unit will pull a driven unit so that water of the water absorbing unit is drained out.

BACKGROUND OF THE INVENTION

In conventional drainage mop, when water saturates in a sponge mop, water in the water absorbing unit is squeeze out for using further. Therefore when water is drained out, the user must bend his (or her) waist and then lift the mop by hands. Then the user squeezes the mop laboriously. When the water absorbing unit is too dirty, the mop is sunk into the water and is pulled several times. Although mops with longer handles are used, to drain water from the handles still needs more force. When the mop is lifted from the ground for draining water. The position of the hand is high and is distant from the water absorbing unit and thus more strength is necessary. Moreover, the new designs about the mops are aimed to change the positions of handles and pull rods. No prior art is aimed to improve above mentioned defect.

SUMMARY OF THE INVENTION

Accordingly, t he primary object of the present invention is to provide a drainage mop. The drainage mop comprises a handle unit having a handle portion and a free end; a press block being placed near an outer wall of the handle unit near a distal end of the handle portion, a water absorbing unit for absorbing water; a drainage unit having a sleeve; the sleeve having a first end and a second end which are arranged oppositely; the first end of the sleeve being adhered to a free end of the handle unit; a pair of wings extending downwards from the second end of the sleeve; free ends of the wings being installed with water absorbing unit; a rotary unit installed between the handle portion of the handle unit and the sleeve of the drainage unit so that the free end of the handle unit being capable of separating from or adhering to a first end of the sleeve; and a driven unit installed between the handle portion of the handle unit and the drainage unit; the driven unit being installed with the water absorbing unit; when a downward pressure is applied to the handle portion of the handle unit, the press block of the handle unit drives the rotary unit and the position of the driven unit is controllable so that the water absorbing unit moves upwards to enter into the wings of the drainage unit and the water absorbing unit is compressed to drain water out.

The various objects and advantages of the present invention will be more readily understood from the following detailed description when read in conjunction with the appended drawing.

DETAILED DESCRIPTION OF THE PREFERRED EMBODIMENTS

Figure 1:
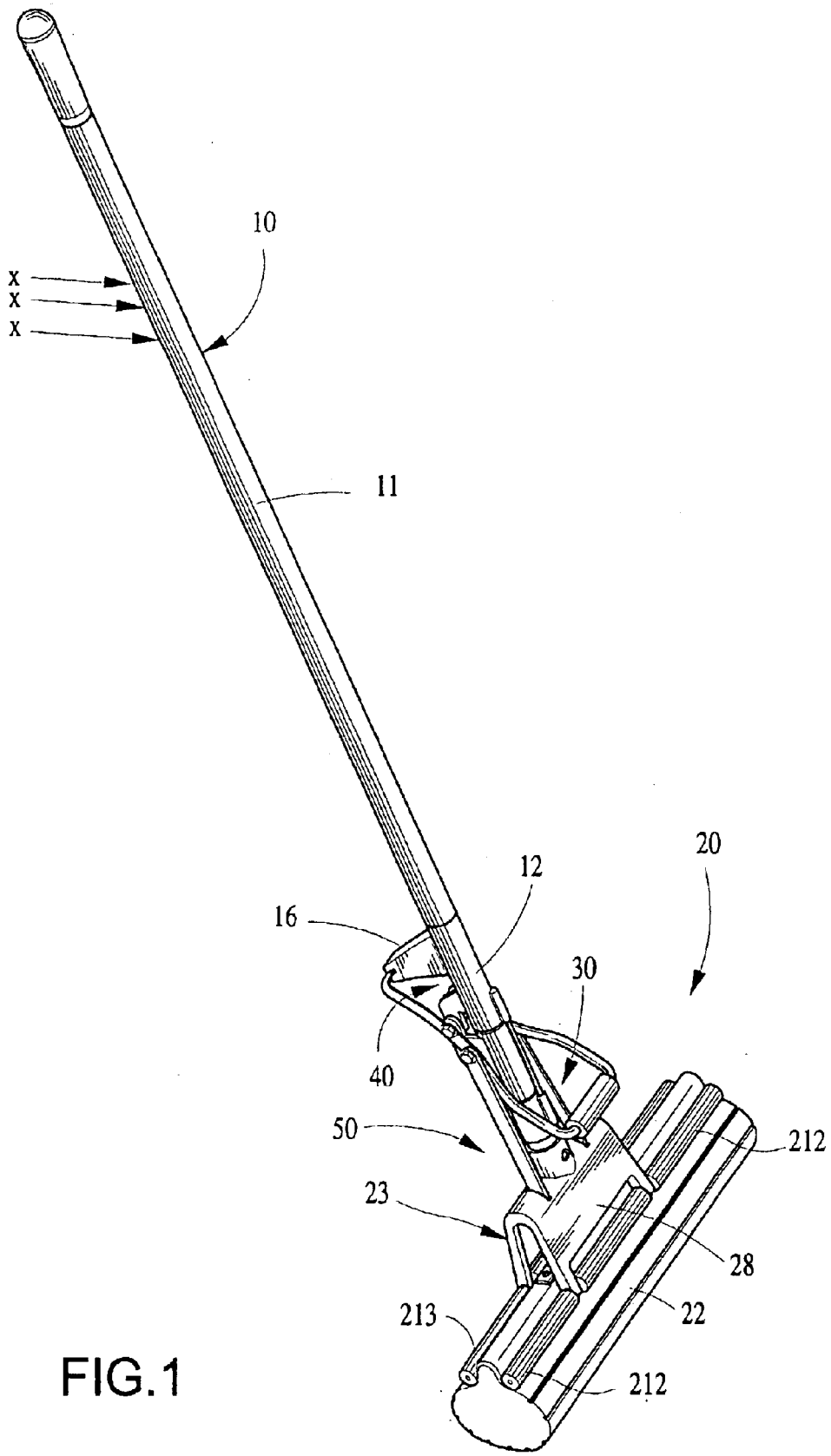
FIG. 1 is a perspective view of the present invention.
Figure 2:
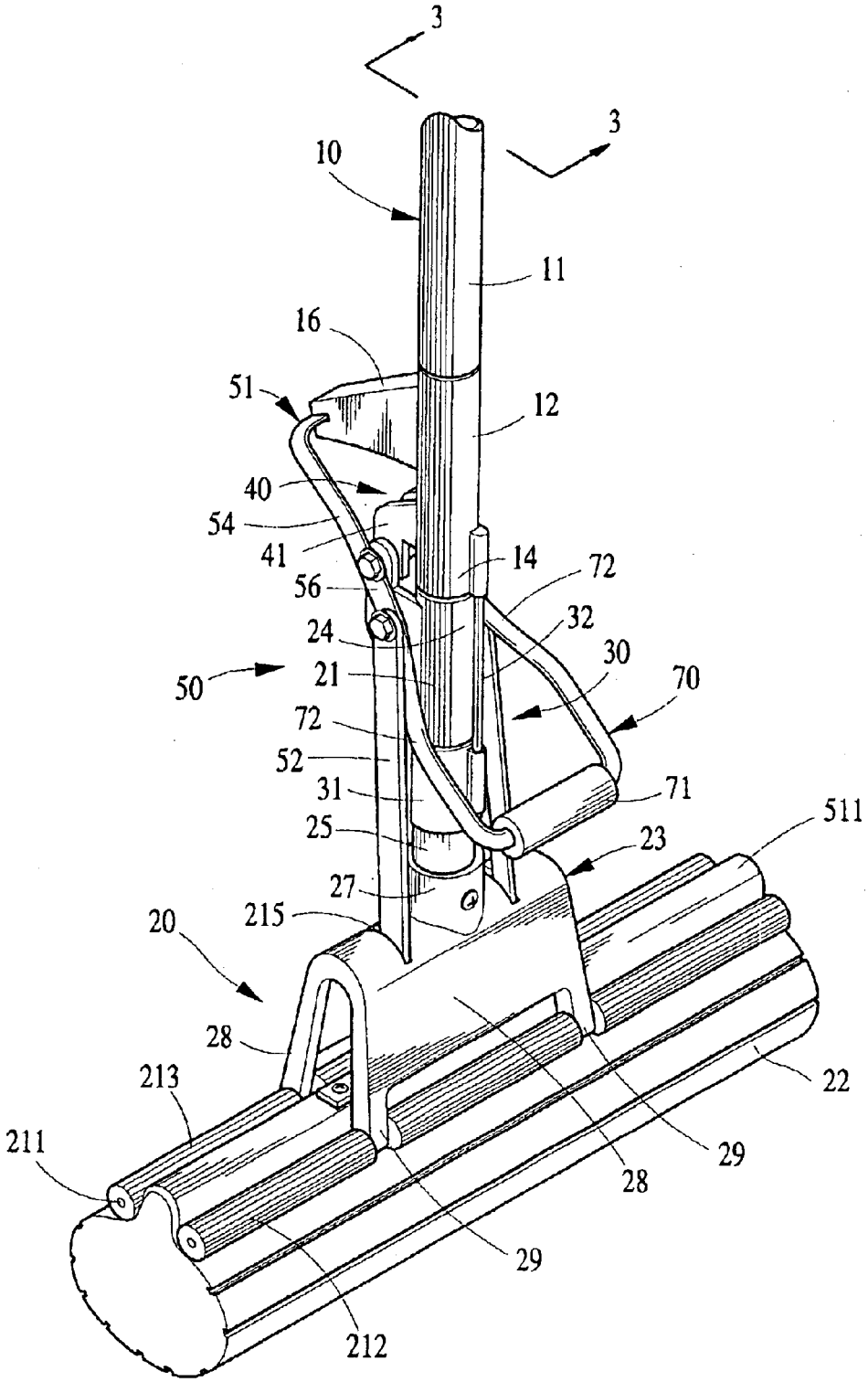
FIG. 2 is a partial enlarged perspective view of FIG. 1.
Figure 3:
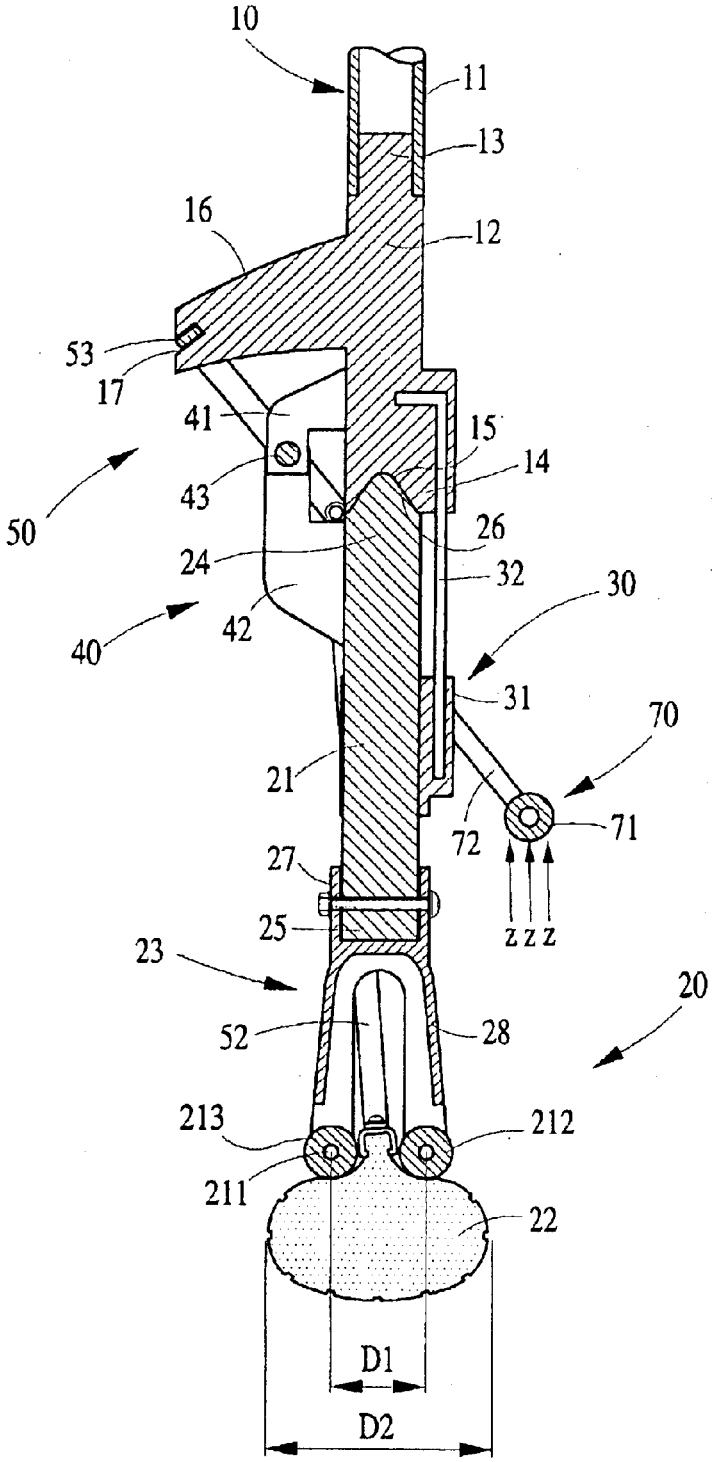
FIG. 3 is a cross section view along line 3—3 of FIG. 2.

Referring to FIGS. 1 to 3, the drainage mop of the present invention is illustrated. The drainage mop includes a handle unit 10, a drainage unit 20, a positioning unit 30, a rotary unit 40, and a driven unit 50.

The handle unit 10 has long tubular handle portion 11. A connecting tube 12 is connected at one end of the handle portion 11 and extends downwards. The connecting tube 12 has a connecting end 13 which is tightly connected to one end of the handle portion 11. A free end 14 extends downwards from the connecting end 13. An end surface of the connecting end 13 is a tapered concave hole 15. An outer wall of the connecting tube 12 has a press block 16. A free end of the press block 16 has an opened groove 17. Preferably, the connecting tube 12 is integrally connected to the handle portion 11.

The drainage unit 20 has a sleeve 21, a water absorbing unit 22 and a supporting element 23. The sleeve 21 has a first end 24 and a second end 25 which are oppositely arranged. The first end 24 has a tapered head 26 for being embedded into the tapered concave hole 15 of the connecting tube 12 so that the first end 24 of the sleeve 21 is connected and adhered to the free end 14 of the connecting tube 12. As a result, the handle unit 10 and the drainage unit 20 are closed along the same axial line.

The water absorbing unit 22 is made by sponge or rubber with preferred water absorbing ability for cleaning dirt on the ground. The water absorbing unit 22 may have various shapes.

The supporting element 23 has a neck 27 connected to the second end 25 of the sleeve 21. Preferably, a stud serves to lock the neck 27 to the second end 25 of the sleeve 21. A pair of spaced wings 28 extend downwards from a horizontal surface of the neck 27. Each water absorbing unit 22 has two legs 29. Each leg 29 has a hole for being inserted by a supporting shaft 211. The extrusion and water absorbing elements 212, 213 (for example, rollers) are rotationably combined to the supporting shaft 211. Each supporting shaft 211 is sleeved by three rollers 212, 213 so that they rotate around the supporting shaft 211. When the connecting tube 12 and sleeve 21 are in closing position, the distance D1 between the rollers 212 and 213 are smaller than the diameter of the water absorbing unit 22.

Figure 5:
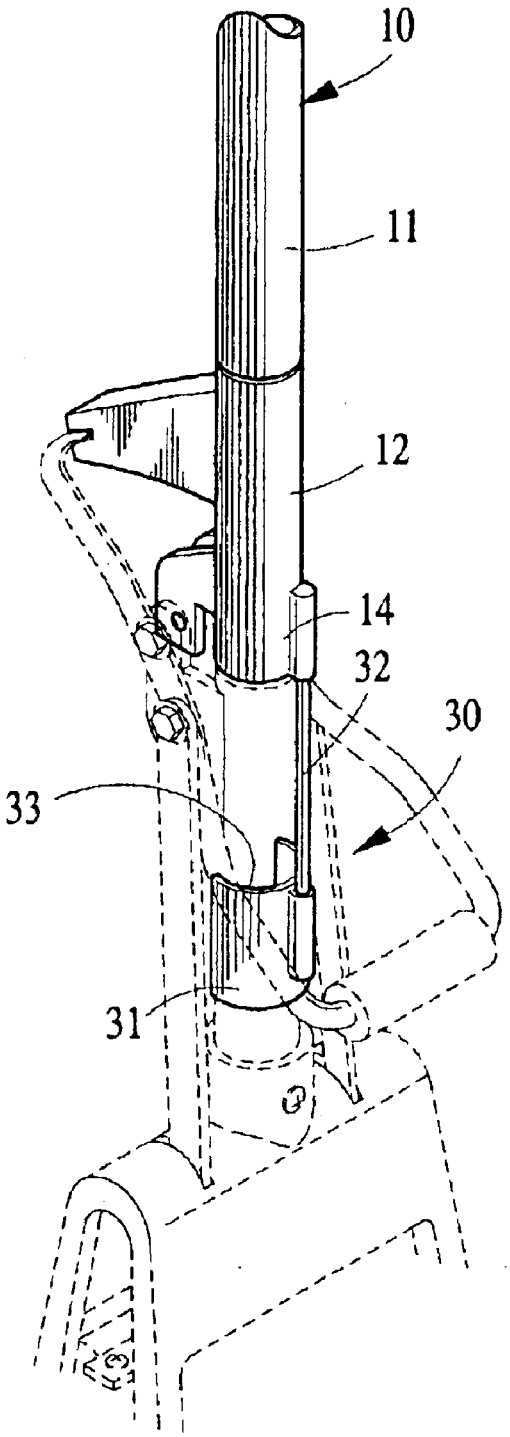
FIG. 5 is a perspective view about the positioning means of the represent invention.

The positioning unit 30 has a buckling reed 31 and a rod 32. The rod have one end being connected to the buckling reed 31 and have another end connected to the free end 14 of the connecting tube 12 so that the buckling reed 31 is controlled by the connecting tube 12 to be connected to or separated from the sleeve 21, as shown in FIG. 5. The buckling reed 31 has a longitudinal notch 33. By this notch 33, the buckling reed 31 can coaxially clamp an outer portion of the sleeve 21 so as to cause the buckling reed 31 and the notch 33 at the same axial line. When the handle unit 10 is bent, the rotary unit 40 separates from the sleeve 21 by using the notch 33.

Figure 4:
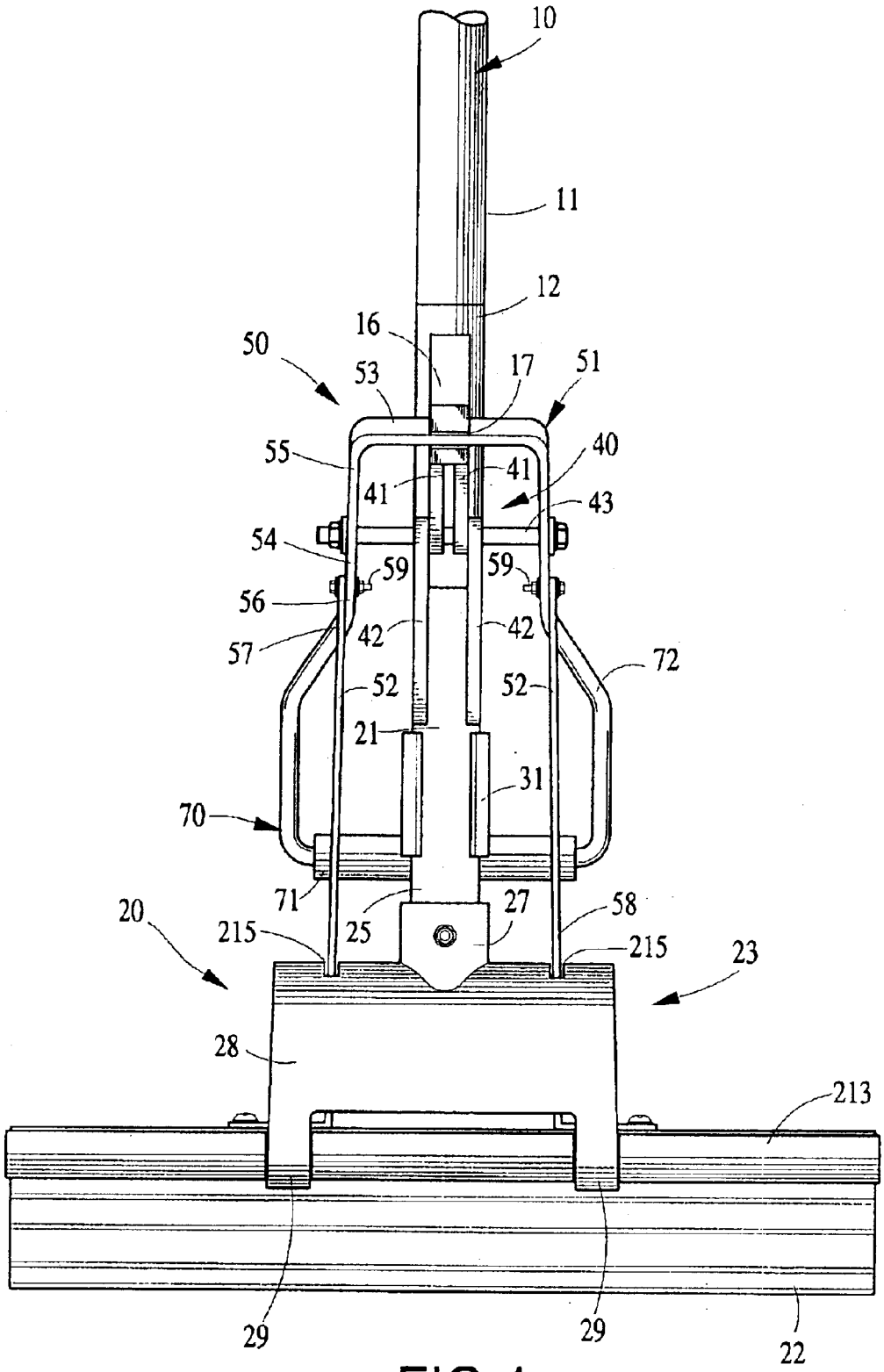
FIG. 4 is a rear view of FIG. 2.

With reference to FIGS. 2, 3 and 4, the rotary unit 40 has a stub 41 and a protrusion 42. A connecting end of the stub 41 is connected to an outer wall of the connecting tube 12.

The connecting end of the protrusion 42 is connected to the first end 24 of the sleeve 21. The stub 41 can be inserted into stub 41. The protrusion 42 has a hole corresponding to a hole of the protrusion 42. Thereby, a supporting bar 43 can insert into the holes so that the rotary unit 40 can rotate around the supporting bar 43.

The driven unit 50 has a press rod 51 and a pair of parallel linkages 52. The press rod 51 has a connecting piece 53 which can be embedded into a recess 17 of the press block 16 so that the connecting piece 53 is interacted by the press block 16 so that a gap is retained between the recess 17 and the connecting piece 53. Two connecting arms 54 are connected and vertically extend between the first connecting end 55 to the second connecting end 56. Each connecting arm 54 has a hole for being inserted by the supporting bar 43 of the rotary unit 40 and the supporting bar 43 is used as a fulcrum.

The linkage 52 has a first end 57 and a second end 58 which are at opposite end. A shaft 59 can be inserted into the first end 57 of the linkage 52 and the second connecting end 56 of the connecting arm 54 so that the linkage 52 is connected to and is rotatable to the connecting arm 54. The second end 58 of the linkage 52 passes through the slot 215 of the supporting element 23 so as to connect to the water absorbing unit 22. Preferably, a retainer 511 is connected to the second end 58 of the linkage 52 and a lower side of the retainer 511 is firmly secured to a top of the water absorbing unit 22 for enhancing the connection of the water absorbing unit 22 and the linkage 52.

Figure 6:
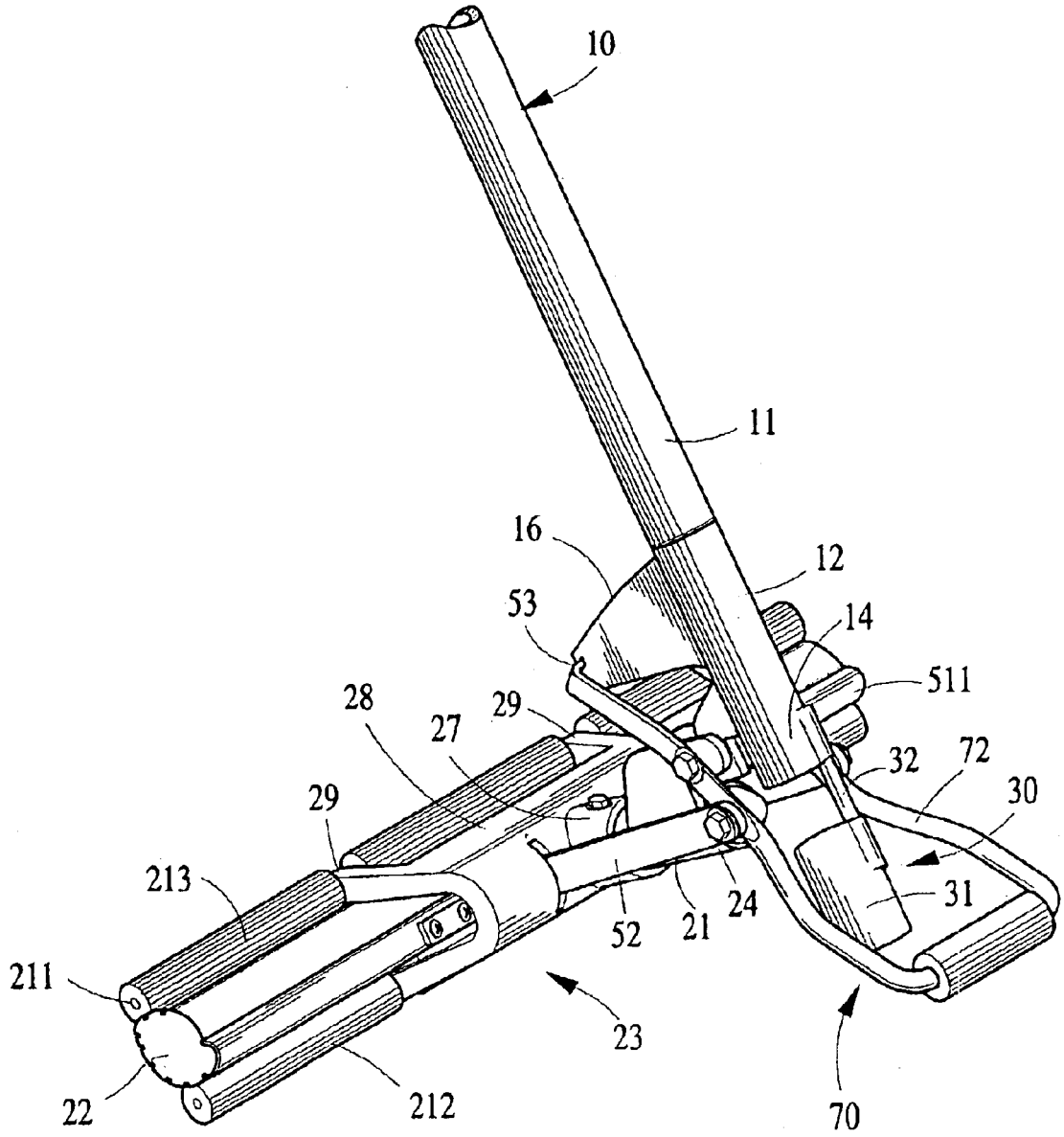
FIG. 6 is a perspective view showing the bending operation of the present invention.

Therefore when a press is applied to the handle portion 11 of the handle unit 10 with a direction "X" shown in FIG. 1, in the handle unit 10, by the rotary unit 40 and the driven unit 50, the water absorbing unit 22 rotates in a position shown in FIG. 6.

Figure 7:
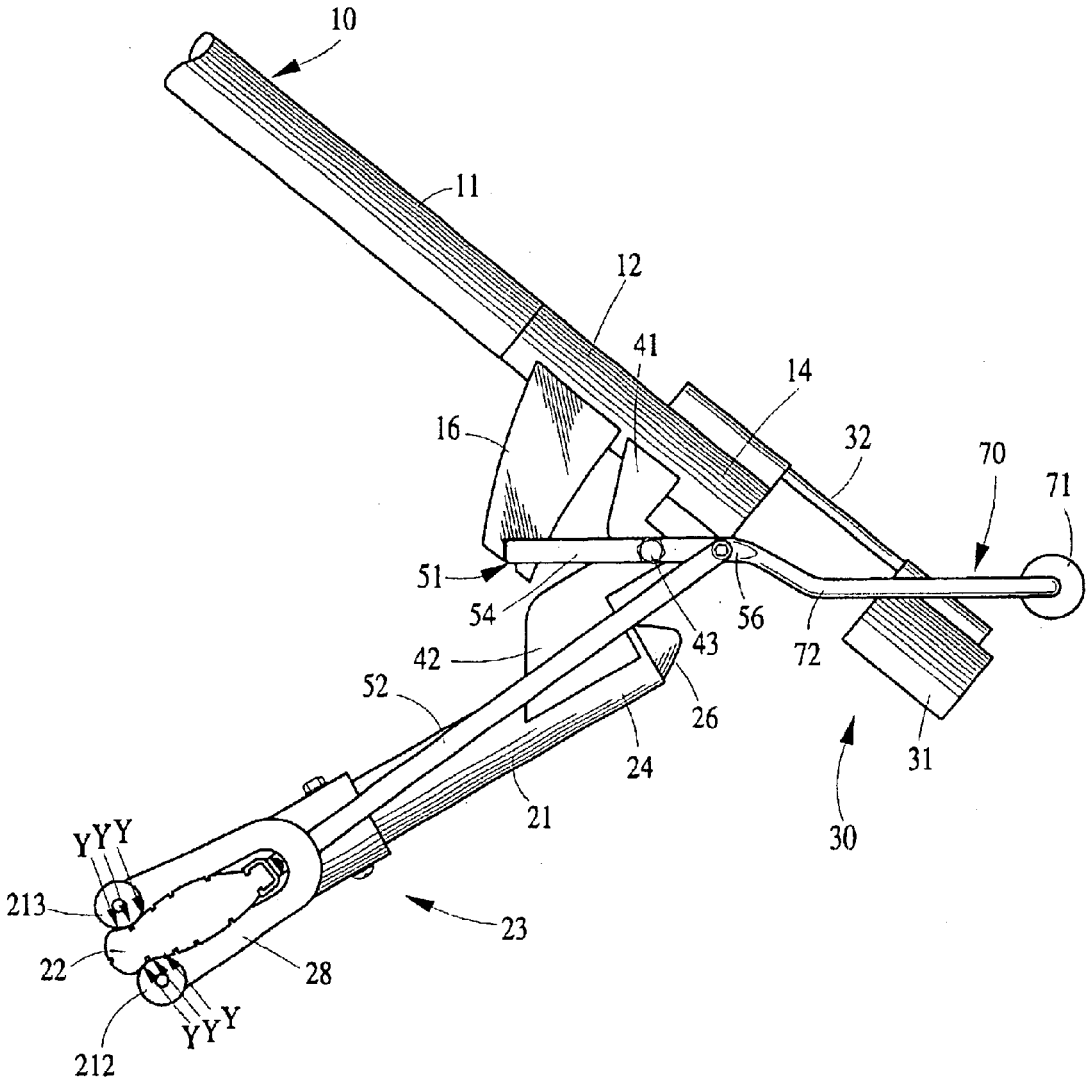
FIG. 7 is a left side view of FIG. 6.

Referring to FIGS. 6 and 7, a perspective view and a lateral view showing that the handle unit 10 is bent with respect to the drainage unit 20. When a pressure in "X" direction is applied to the handle portion 11, the supporting bar 43 of the handle portion 11 moves downwards so that the free end 14 of the connecting tube 12 separates from the first end 24 of the sleeve 21 to be in a bending condition. Then, buckling reed 31 of the positioning means 30 moves upwards with the connecting tube 12 to enforce the buckling reed 31 separates from the sleeve 21. The handle portion 11 will drive the press block 16 to move. The press block 16 applies a force to the connecting piece 53 of the press rod 51. The connecting piece 53 will cause the connecting arm 54 to have a fulcrum of the supporting arm 43. Thereby, the second connecting ends 56 of the connecting arms 54 move upwards. When the second connecting ends 56 move upwards, the pair of linkages 52 are driven to move upwards. The linkages 52 will pull the water absorbing unit 22 upwards so that the water absorbing unit 22 are radially compressed by the rollers 212, 213 to have a smaller diameter. In fact, the water absorbing unit 22 is compressed by an extrusion, force as indicated by the arrow "Y" in FIG. 7 so that water will drain out.

When water drains out, a pull force is applied to the handle portion 11 so that the free end 14 of the connecting tube 12 is near the first end 24 of the sleeve 21 so as to be in a close state. Thereby, the handle unit 10 can restore to the original position, as shown in FIG. 1 for working. Thereby, the rotary unit 40 can bend the handle unit 10 with respect to the drainage unit 20. Furthermore, the water absorbing unit 22 is pulled by the driven unit 50 so as to be compressed radially. Thus, force is saved.

Figure 8:
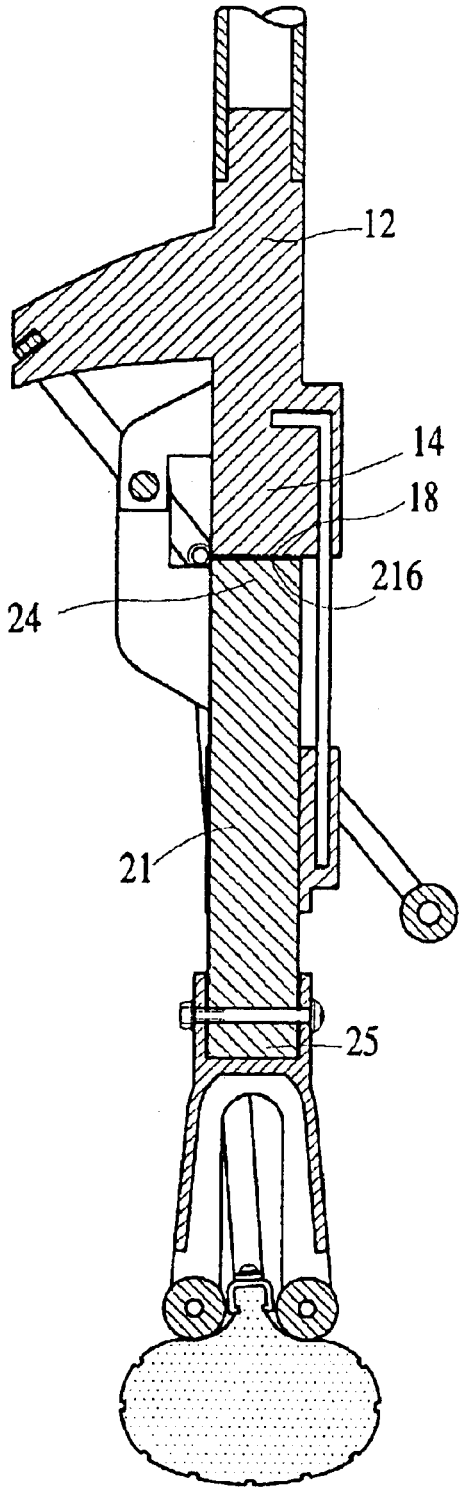
FIG. 8 is a partial cross section view of another preferred embodiment of the present invention.

Referring to FIG. 8, the second embodiment of the present invention is illustrated. The free end 14 of the connecting tube 12 has a closed flat bottom 18 which can be adhered to or separated from the closed flat bottom 216 of the sleeve 21.

Figure 10:
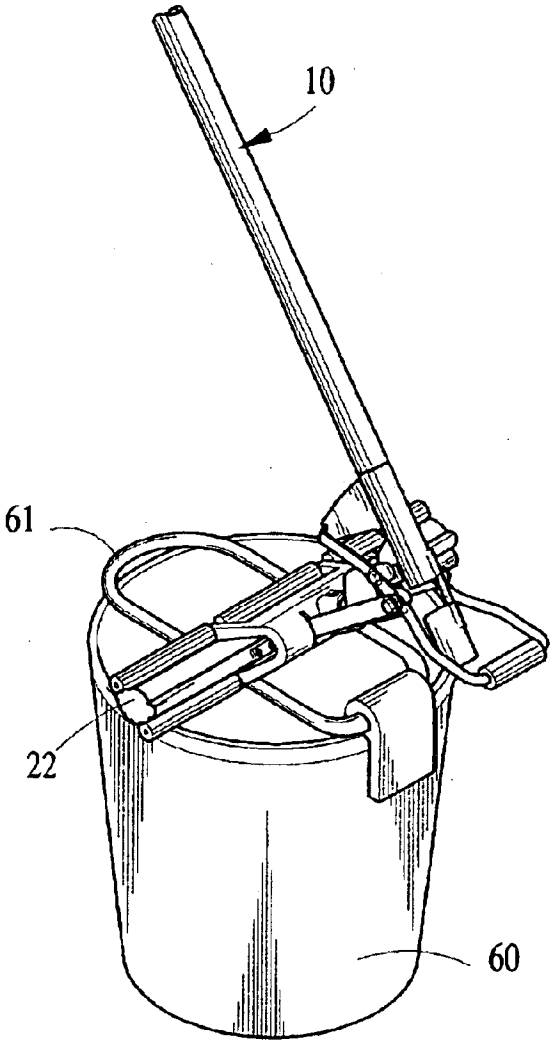
FIGS. 9 and 10 are schematic views showing that the present invention is placed on a barrier.
Figure 9:
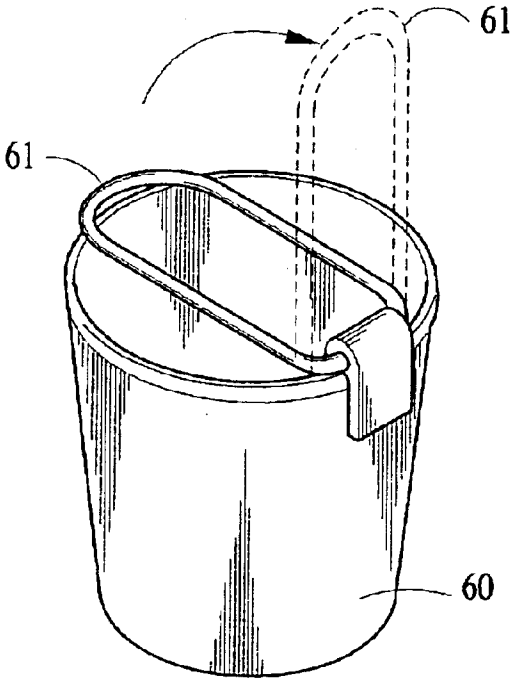

With reference to FIGS. 9 and 10, the schematic views about cleaning and drainage of the drainage mop of the present invention is illustrated. The drainage mop cleans and drains through a barrier 60. The barrier 60 (for example, a stool or a water barrier) is installed with a door 61. In cleaning, the door 61 can be opened and the drainage mop is placed into the barrier 60. The handle unit 10 is bent several times so that the dirt on the water absorbing unit 22 can be removed. In draining, the drainage mop is placed on the door 61 and the handle unit 10 is bent so that water in the water absorbing unit 22 is drained to flow into the barrier 60.

With reference to FIGS. 2 and 3, preferably, the drainage mop of the present invention has a hand rod 70 which has a pull portion 71 and a connecting portion 72. The connecting portion 72 is connected to the second connecting end 56 of the connecting arm 54. Moreover, the connecting portion 72 of the hand rod 70 is integrally formed with the second connecting end 56 of the connecting arm 54.

When a pull force as indicated by "Z", of FIG. 3 is applied to the pull portion 71 of the handle 70, the pull portion 71 will pull the linkages 52 so that the water absorbing unit 22 moves upwards. The wings 28 of the drainage unit 20 have predetermined shape so that the water absorbing unit 22 are protruded radially to achieve the object of drainage. Therefore in the drainage mop of the present invention, the drainage of water absorbing unit 22 can be performed by bending or pulling manually. Thus, the operation is convenient.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A drainage mop comprising:

a handle unit having a handle portion and a free end; a press block being placed on an outer wall of the handle unit near a distal end of the handle portion;

a water absorbing unit for absorbing water;

a drainage unit having a sleeve; the sleeve having a first end and a second end which are arranged at opposite ends; the first end of the sleeve being adhered to a free end of the handle unit; a pair of wings extending downwards from the second end of the sleeve; free ends of the wings being installed with water absorbing unit;

a rotary unit installed between the handle portion of the handle unit and the sleeve of the drainage unit so that the free end of the handle unit being capable of separating from or adhering to a first end of the sleeve; and a driven unit installed between the handle portion of the handle unit and the drainage unit; the driven unit being installed with the water absorbing unit; wherein when a downward pressure is applied to the handle portion of the handle unit, the press block of the handle unit drives the rotary unit and the position of the driven unit is controllable so that the water absorbing unit moves upwards to enter into the wings of the drainage unit; and the water absorbing unit is compressed to drain water out.

2. The drainage mop as claimed in claim 1, wherein the rotary unit has a protrusion and a stub for inserting into the protrusion; the stub is joined to the protrusion by a supporting bar so that the rotary unit can rotate around the supporting bar.

3. The drainage mop as claimed in claim 1, wherein the driven unit has a press rod and a pair of parallel linkages; the press rod is installed below the press block and mounted to a supporting bar which acts as a fulcrum of the rotary unit; the press rod and the linkages are rotatably installed to the sleeve of the drainage unit so that a force applied to the press block of the handle portion can control the movement of the press rod; since one end of the linkages are combined to the water absorbing unit, the water absorbing unit moves upwards with the linkages.

4. The drainage mop as claimed in claim 3, wherein the press rod is formed by a connecting piece and two connecting arms vertically installed at a distal end of the connecting piece.

5. The drainage mop as claimed in claim 4, wherein the press block of the handle portion has a recess for receiving the connecting piece of the press rod and retaining a proper gap therebetween.

6. The drainage mop as claimed in claim 4, wherein a hand rod extends outwards from the connecting arms of the press rod for controlling the upward movement of the linkages so that the water absorbing unit moves upwards and drains water out.

7. The drainage mop as claimed in claim 1, wherein rollers are used to squeeze the water absorbing unit.

8. The drainage mop as claimed in claim 1, wherein a free end of the handle unit is a tapered concave hole for adhering to or separating from a tapered head of the first end of the sleeve.

9. The drainage mop as claimed in claim 1, wherein the free end of the handle unit is a closed flat bottom for adhering to or separating from the closed flat bottom of the first end of the sleeve.

10. The drainage mop as claimed in claim 1, wherein a positioning means is disposed between the handle unit and the drainage unit; the positioning means has a buckling reed and a rod; the buckling reed is arranged to enclose an outer portion of the sleeve of the drainage unit so that the buckling reed buckles and positions the drainage unit; one end of the rod is combined to the handle unit, and another end of the rod is combined to the buckling reed; when a downward pressure is applied to the handle unit, the buckling reed for driving the positioning means moves upwards so that the buckling reed is separated from the drainage unit.

* * * * *